US008047390B2

(12) United States Patent
Strasser et al.

(10) Patent No.: US 8,047,390 B2
(45) Date of Patent: Nov. 1, 2011

(54) CONTAINER HAVING VACUUM PANELS

(75) Inventors: Walter J. Strasser, Cement City, MI (US); Steve P. Barker, Brooklyn, MI (US)

(73) Assignee: Amcor Limited, Hawthorn, Victoria (AU)

( * ) Notice: Subject to any disclaimer, the term of this patent is extended or adjusted under 35 U.S.C. 154(b) by 987 days.

(21) Appl. No.: 11/879,005

(22) Filed: Jul. 13, 2007

(65) Prior Publication Data

US 2009/0014407 A1 Jan. 15, 2009

(51) Int. Cl.
*B65D 1/40* (2006.01)

(52) U.S. Cl. ..... 215/381; 215/382; 220/669; 220/675; 40/310

(58) Field of Classification Search ..... 215/381, 215/382; 220/666, 669, 675; 40/310
See application file for complete search history.

(56) References Cited

U.S. PATENT DOCUMENTS

| | | | | | |
|---|---|---|---|---|---|
| D295,381 | S | * | 4/1988 | Papa | D9/520 |
| 4,749,092 | A | * | 6/1988 | Sugiura et al. | 215/381 |
| 4,818,575 | A | * | 4/1989 | Hirata et al. | 428/36.7 |
| 5,054,632 | A | * | 10/1991 | Alberghini et al. | 215/381 |
| 5,060,453 | A | * | 10/1991 | Alberghini et al. | 53/440 |
| 5,067,622 | A | * | 11/1991 | Garver et al. | 215/381 |
| 5,222,615 | A | * | 6/1993 | Ota et al. | 215/375 |
| 5,303,834 | A | * | 4/1994 | Krishnakumar et al. | 215/381 |
| 5,341,946 | A | | 8/1994 | Valliencourt et al. | |
| D386,418 | S | * | 11/1997 | Edstrom et al. | D9/538 |
| D393,802 | S | * | 4/1998 | Collette et al. | D9/502 |
| 5,762,221 | A | * | 6/1998 | Tobias et al. | 215/381 |
| D396,810 | S | * | 8/1998 | Riffer | D9/553 |
| 6,036,037 | A | * | 3/2000 | Scheffer et al. | 215/381 |
| 6,223,920 | B1 | | 5/2001 | Lane et al. | |
| D465,151 | S | | 11/2002 | Mixon | |
| 6,513,669 | B2 | | 2/2003 | Ozawa et al. | |
| 6,662,960 | B2 | * | 12/2003 | Hong et al. | 215/381 |
| 6,666,001 | B2 | * | 12/2003 | Mero | 53/413 |
| 6,830,158 | B2 | * | 12/2004 | Yourist | 215/381 |
| 6,932,230 | B2 | | 8/2005 | Pedmo et al. | |
| 7,004,342 | B2 | | 2/2006 | Bourque et al. | |
| 2001/0037992 | A1 | * | 11/2001 | Tanabe et al. | 215/384 |
| 2002/0000421 | A1 | * | 1/2002 | Ota et al. | 215/381 |
| 2003/0161980 | A1 | * | 8/2003 | Nelson | 428/36.7 |
| 2004/0016716 | A1 | * | 1/2004 | Melrose et al. | 215/381 |
| 2004/0195199 | A1 | * | 10/2004 | Maki et al. | 215/381 |
| 2007/0012650 | A1 | * | 1/2007 | Eble | 215/382 |

FOREIGN PATENT DOCUMENTS

| | | | |
|---|---|---|---|
| CH | 651 263 | | 9/1985 |
| EP | 1 886 925 | | 2/2008 |
| JP | 08011858 | A * | 1/1996 |
| JP | 08192850 | A * | 7/1996 |
| WO | WO 2005/100199 | A1 * | 10/2005 |

* cited by examiner

*Primary Examiner* — Sue Weaver
(74) *Attorney, Agent, or Firm* — Harness, Dickey & Pierce, P.L.C.

(57) ABSTRACT

A plastic container includes an upper portion having a mouth defining an opening into the container. A shoulder region extends from the upper portion. A sidewall portion extends between the shoulder region and a base portion. The base portion closes off an end of the container. A vacuum panel region defined in part by at least two vacuum panels. Each of the vacuum panels are movable to accommodate vacuum forces generated within the container resulting from heating and cooling of its contents. The vacuum panel region occupies an area outboard of the sidewall portion.

18 Claims, 6 Drawing Sheets

CONTAINER HAVING VACUUM PANELS

TECHNICAL FIELD

This disclosure generally relates to plastic containers for retaining a commodity, and in particular a liquid commodity. More specifically, this disclosure relates to a plastic container having a vacuum panel region defined on the plastic container in an area distinct from a sidewall having a label panel area.

BACKGROUND

As a result of environmental and other concerns, plastic containers, more specifically polyester and even more specifically polyethylene terephthalate (PET) containers are now being used more than ever to package numerous commodities previously supplied in glass containers. Manufacturers and fillers, as well as consumers, have recognized that PET containers are lightweight, inexpensive, recyclable and manufacturable in large quantities.

Blow-molded plastic containers have become commonplace in packaging numerous commodities. PET is a crystallizable polymer, meaning that it is available in an amorphous form or a semi-crystalline form. The ability of a PET container to maintain its material integrity relates to the percentage of the PET container in crystalline form, also known as the "crystallinity" of the PET container. The following equation defines the percentage of crystallinity as a volume fraction:

$$\%\ \text{Crystallinity} = \left(\frac{\rho - \rho_a}{\rho_c - \rho_a}\right) \times 100$$

where $\rho$ is the density of the PET material; $\rho_a$ is the density of pure amorphous PET material (1.333 g/cc); and $\rho_c$ is the density of pure crystalline material (1.455 g/cc).

Container manufacturers use mechanical processing and thermal processing to increase the PET polymer crystallinity of a container. Mechanical processing involves orienting the amorphous material to achieve strain hardening. This processing commonly involves stretching an injection molded PET preform along a longitudinal axis and expanding the PET preform along a transverse or radial axis to form a PET container. The combination promotes what manufacturers define as biaxial orientation of the molecular structure in the container. Manufacturers of PET containers currently use mechanical processing to produce PET containers having approximately 20% crystallinity in the container's sidewall.

Thermal processing involves heating the material (either amorphous or semi-crystalline) to promote crystal growth. On amorphous material, thermal processing of PET material results in a spherulitic morphology that interferes with the transmission of light. In other words, the resulting crystalline material is opaque, and thus, generally undesirable. Used after mechanical processing, however, thermal processing results in higher crystallinity and excellent clarity for those portions of the container having biaxial molecular orientation. The thermal processing of an oriented PET container, which is known as heat setting, typically includes blow molding a PET preform against a mold heated to a temperature of approximately 250° F.-350° F. (approximately 121° C.-177° C.), and holding the blown container against the heated mold for approximately two (2) to five (5) seconds. Manufacturers of PET juice bottles, which must be hot-filled at approximately 185° F. (85° C.), currently use heat setting to produce PET bottles having an overall crystallinity in the range of approximately 25%-35%.

After being hot-filled, the heat-set containers may be capped and allowed to reside at generally the filling temperature for approximately five (5) minutes at which point the container, along with the product, is then actively cooled prior to transferring to labeling, packaging, and shipping operations. The cooling reduces the volume of the liquid in the container. This product shrinkage phenomenon results in the creation of a vacuum within the container. Generally, vacuum pressures within the container range from 1-380 mm Hg less than atmospheric pressure (i.e., 759 mm Hg-380 mm Hg). If not controlled or otherwise accommodated, these vacuum pressures result in deformation of the container, which leads to either an aesthetically unacceptable container or one that is unstable. Hot-fillable plastic containers must provide sufficient flexure to compensate for the changes of pressure and temperature, while maintaining structural integrity and aesthetic appearance. Typically, the industry accommodates vacuum related pressures with sidewall structures or vacuum panels formed within the sidewall of the container. Such vacuum panels generally distort inwardly under vacuum pressures in a controlled manner to eliminate undesirable deformation.

While such vacuum panels allow containers to withstand the rigors of a hot-fill procedure, the panels have limitations and drawbacks. First, such panels formed within the sidewall of a container do not create a generally smooth glass-like appearance. Second, packagers often apply a wrap-around or sleeve label to the container over these panels. The appearance of these labels over the vacuum panels is such that the label often becomes wrinkled and not smooth. Additionally, one grasping the container generally feels the vacuum panels beneath the label and often pushes the label into various panel crevasses and recesses.

SUMMARY

A plastic container includes an upper portion having a mouth defining an opening into the container. A shoulder region extends from the upper portion. A sidewall portion extends between the shoulder region and a base portion. The base portion closes off an end of the container. A vacuum panel region is defined in part by at least two vacuum panels. Each of the vacuum panels are movable to accommodate vacuum forces generated within the container resulting from heating and cooling of its contents. The vacuum panel region occupies an area outboard of the sidewall portion.

According to additional features, the vacuum panels each define a plane that is substantially parallel to a longitudinal axis of the plastic container. The vacuum panels can be generally rectangular shaped. In one example, the vacuum panels include three pair of vacuum panels. Each vacuum panel opposes a corresponding vacuum panel. The sidewall portion includes a series of horizontal ribs that substantially circumscribe a perimeter of the sidewall portion.

According to another example, the vacuum panel region can comprise a first vacuum panel region and a second vacuum panel region. The sidewall portion is formed intermediate of the first and second vacuum panel regions. Both of the first and second vacuum panel regions define three pair of vacuum panels.

Additional benefits and advantages of the present disclosure will become apparent to those skilled in the art to which the present disclosure relates from the subsequent description and the appended claims, taken in conjunction with the accompanying drawings.

DETAILED DESCRIPTION

The following description is merely exemplary in nature, and is in no way intended to limit the disclosure or its application or uses.

Figure 1:
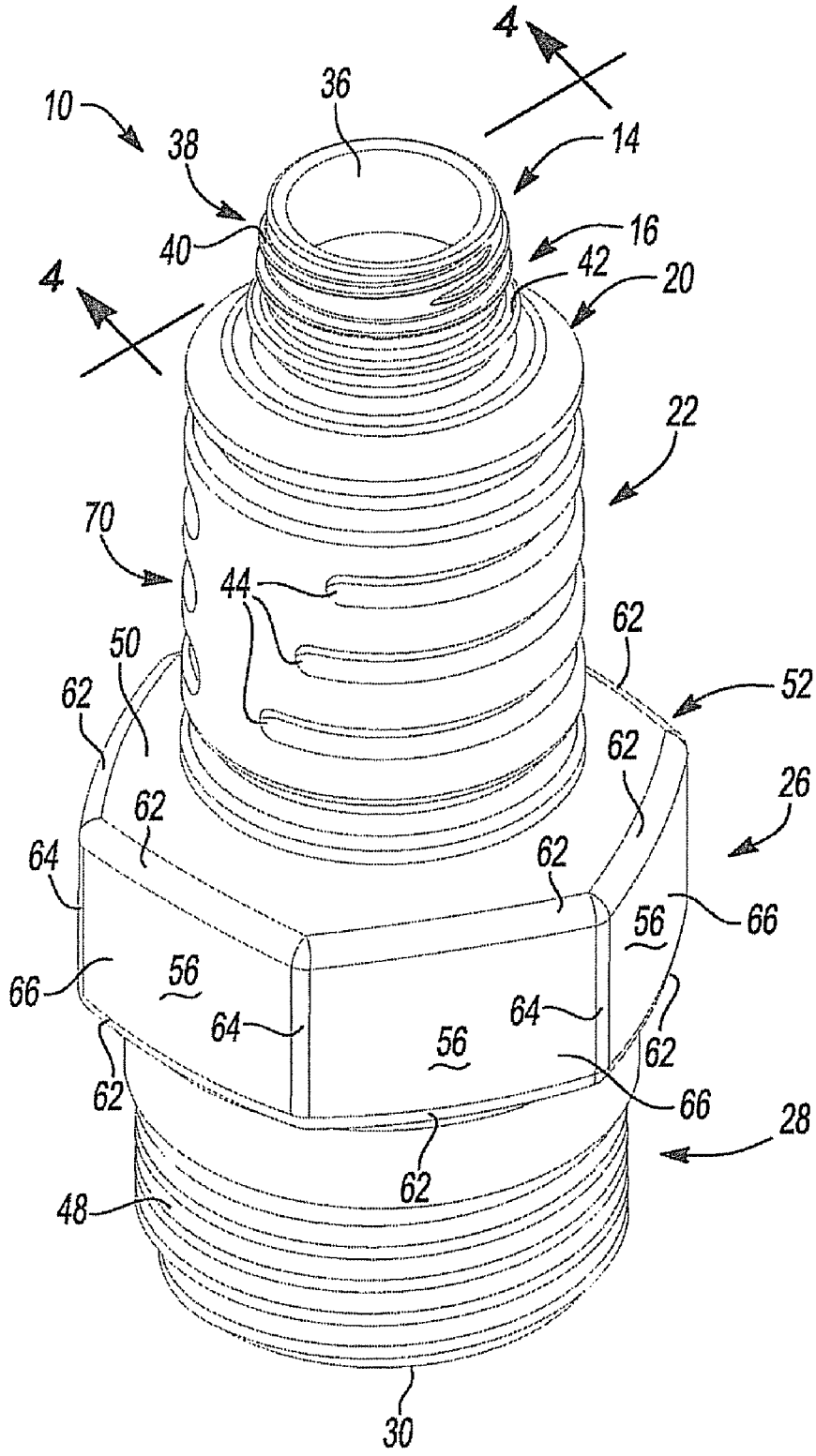
FIG. 1 is a perspective view of a plastic container constructed in accordance with the teachings of the present disclosure.
Figure 2:
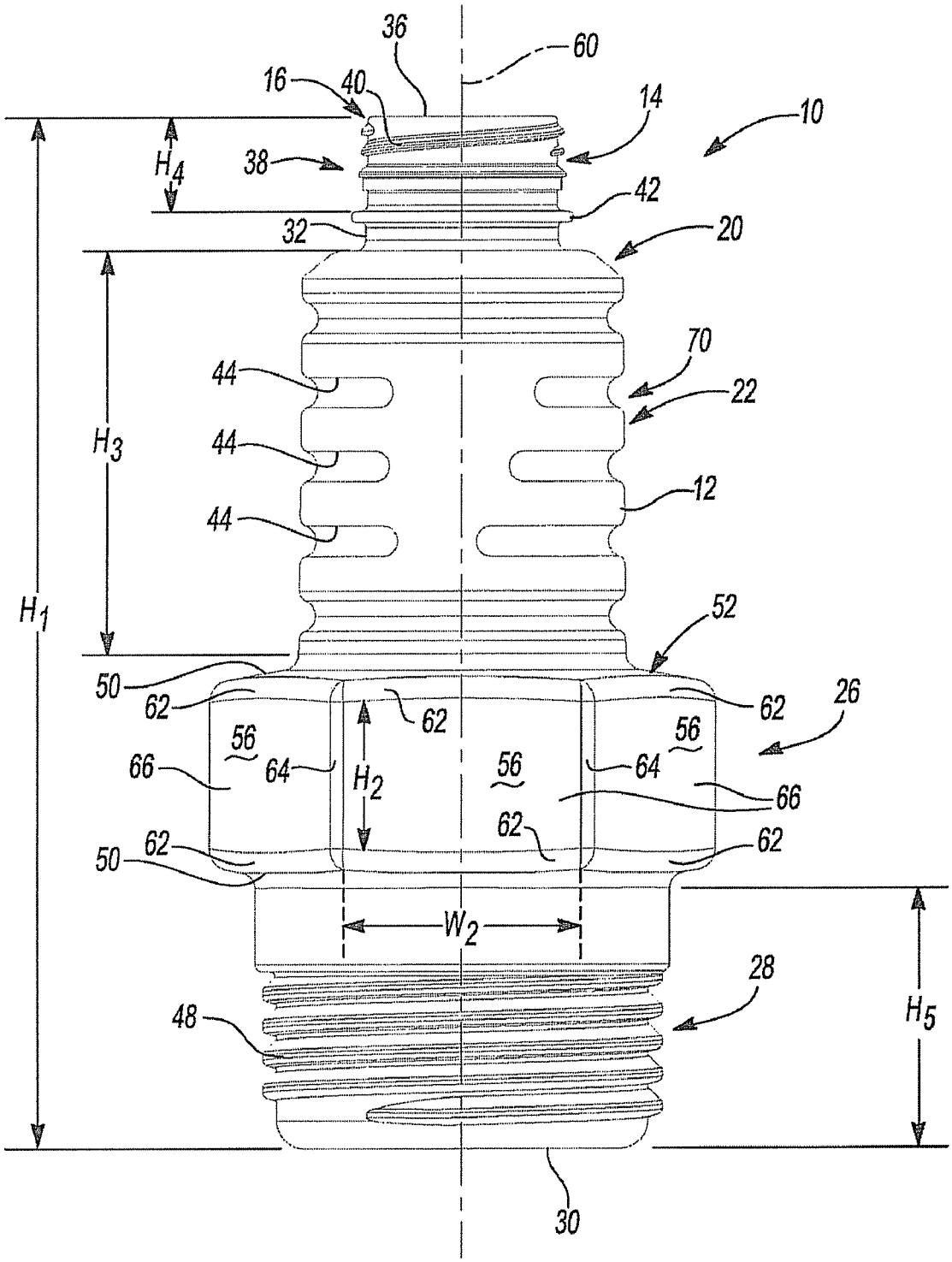
FIG. 2 is a side elevational view of the plastic container of FIG. 1.
Figure 3:
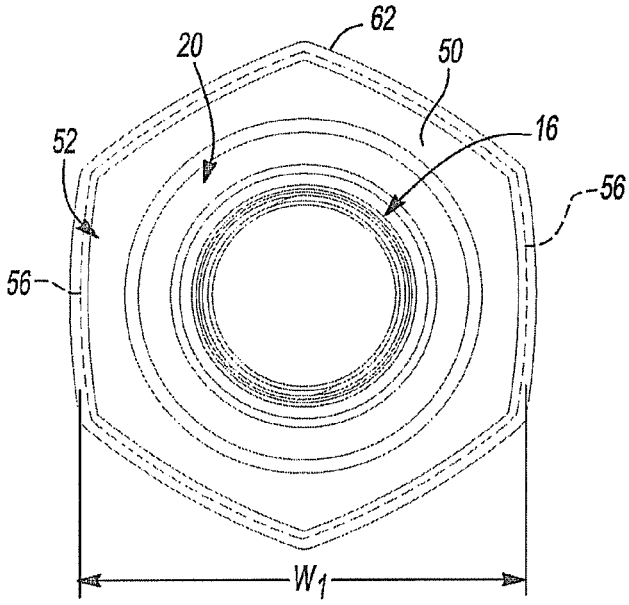
FIG. 3 is a top view of the plastic container of FIG. 1.

With reference to FIGS. 1-4, a plastic, e.g. polyethylene terephthalate (PET), hot-fillable container according to the present teachings is shown and generally identified at reference number 10. As shown in FIG. 2, the plastic container 10 has an overall height $H_1$ of about 190.3 mm (7.49 inches). The height $H_1$ may be selected so that the plastic container 10 fits on the shelves of a supermarket or store. In this particular embodiment, the plastic container 10 has a volume capacity of about 20 fl. oz. (591 cc). Those of ordinary skill in the art would appreciate that the following teachings are applicable to other containers, such as containers having different shapes, which may have different dimensions and volume capacities. It is also contemplated that other modifications can be made depending on the specific application and environmental requirements.

The plastic container 10 according to the present teachings defines a body 12 and includes an upper portion 14 having a finish 16. Integrally formed with the finish 16 and extending downward therefrom is a shoulder region 20. The shoulder region 20 merges into and provides a transition between the finish 16 and a sidewall portion 22. The sidewall portion 22 extends downward from the shoulder region 20 to a vacuum panel region 26. The vacuum panel region 26 merges into a base portion 28 having a base 30. A neck 32 may also be included having an extremely short height, that is, becoming a short extension from the finish 16, or an elongated height, extending between the finish 16 and the shoulder region 20. The plastic container 10 has been designed to retain a commodity. The commodity may be in any form such as a solid or liquid product. In one example, a liquid commodity may be introduced into the plastic container 10 during a thermal process, typically a hot-fill process. For hot-fill bottling applications, bottlers generally fill the plastic container 10 with a liquid or product at an elevated temperature between approximately 155° F. to 205° F. (approximately 68° C. to 96° C.) and seal the plastic container 10 with a cap (not illustrated) before cooling. In addition, the plastic container 10 may be suitable for other high-temperature pasteurization or retort filling processes or other thermal processes as well. In another example, the commodity may be introduced into the plastic container 10 under ambient temperatures.

The finish 16 of the plastic container 10 includes a portion defining an aperture or mouth 36, and a threaded region 38 having threads 40. The finish 16 can also define a support ring 42. The support ring 42 may be used to carry or orient a preform (the precursor to the plastic container 10, not illustrated) through and at various stages of manufacture. For example, the preform may be carried by the support ring 42, the support ring 42 may be used to aid in positioning the preform in the mold, or an end consumer may use the support ring 42 to carry the plastic container 10 once manufactured.

The aperture 36 allows the plastic container 10 to receive a commodity while the threaded region 38 provides a means for attachment of a similarly threaded closure or cap (not illustrated). Alternatives may include other suitable devices that engage the finish 16 of the plastic container 10. Accordingly, the closure or cap (not illustrated) engages the finish 16 to preferably provide a hermetical seal of the plastic container 10. The closure or cap (not illustrated) is preferably of a plastic or metal material conventional to the closure industry and suitable for subsequent thermal processing, including high temperature pasteurization and retort.

The sidewall portion 22 includes a series of horizontal ribs 44. The horizontal ribs 44 substantially circumscribe the entire perimeter of the sidewall portion 22 of the plastic container 10. The horizontal ribs 44 extend continuously in a longitudinal direction from the shoulder region 20 to the vacuum panel region 26. According to one example, the sidewall portion 22 can define a width $W_5$. The width $W_5$ can be approximately 60 mm (2.36 inches). The base 30 functions to close off the base portion 28 of the plastic container 10 and, together with the finish 16, the shoulder region 20, the sidewall portion 22, and the vacuum panel region 26, to retain the commodity. The base portion 28 generally defines an outer surface having a thread detail 48 formed therearound. The thread detail 48 can assist in providing structural integrity to the base portion 28 as well as provide an ornamental appeal to the plastic container 10. Additionally, the thread detail 48 may facilitate attachment of a secondary container or closure.

The vacuum panel region 26 is generally defined between lateral surfaces 50 at a stepped-out portion 52 of the plastic container 10. The vacuum panel region 26 defines a plurality of vacuum panels 56 generally extending on respective planes that are parallel to a central longitudinal axis 60 of the plastic container 10. According to one example, the stepped-out portion 52 can define a width $W_1$ between opposing vacuum panels 56. The width $W_1$ can be approximately 85 mm (3.35 inches). Preferably, the width $W_1$ may be at least 10% greater than the width $W_5$. More preferably, the width $W_1$ may be about 20%-40% greater than the width $W_5$.

As illustrated in FIGS. 1-4, the vacuum panels 56 may be generally rectangular in shape. It is appreciated that the vacuum panels 56 may define other geometrical configurations as well. Accordingly, the plastic container 10 illustrated in the FIGS. 1-4 has six (6) vacuum panels 56. The inventors however equally contemplate that more than or less than six (6) vacuum panels 56 can be provided. By way of example, the vacuum panel region 26 can also be formed on the plastic container 10 having two (2), three (3), four (4), five (5), seven (7) or eight (8) vacuum panels. As illustrated, the present teachings facilitate the orientation of vacuum panels 56 in a horizontal direction relative to the central longitudinal axis 60 of the plastic container 10. Surrounding the vacuum panels 56 are horizontal and vertical connecting walls 62 and 64, respectively. Each horizontal connecting wall 62 is generally defined between the vacuum panel 56 and respective lateral surfaces 50. The horizontal connecting walls 62 define a generally arcuate profile in horizontal cross-section (see FIG. 4). Each vertical connecting wall 64 is defined between adjacent vacuum panels 56.

Optionally, each horizontal connecting wall 62 may define a distinctly identifiable structure between the lateral surfaces 50 and an underlying surface 66 of vacuum panels 56. The horizontal connecting walls 62 provide strength to the transition between the lateral surfaces 50 and the underlying surface 66 of the vacuum panels 56. The resulting localized strength increases the resistance to creasing and denting in the vacuum panel region 26 and the plastic container 10 as a whole.

A label panel area 70 is defined at the sidewall portion 22. The label panel area 70 therefore occupies a distinct portion of the plastic container 10 relative to the vacuum panel region 26. As is commonly known and understood by container manufacturers skilled in the art, a label (not shown) may be applied to the sidewall portion 22 (label panel area 70) using methods that are well known to those skilled in the art, including shrink-wrap labeling and adhesive methods. As applied, the label may extend around the entire body 12 or be limited to a partial circumference of the sidewall portion 22.

Figure 4:
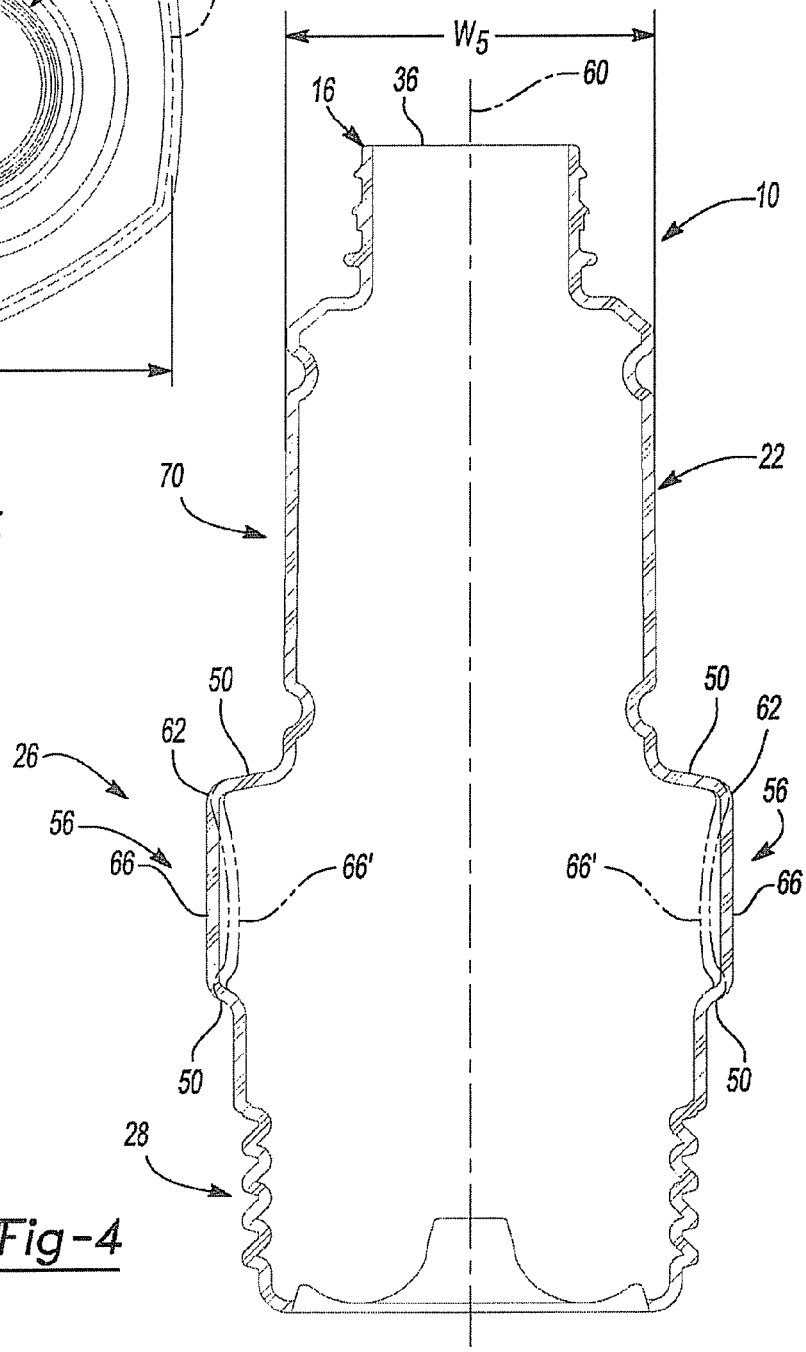
FIG. 4 is a cross-sectional view of the plastic container taken along line 4-4 of FIG. 1.
Figure 5:
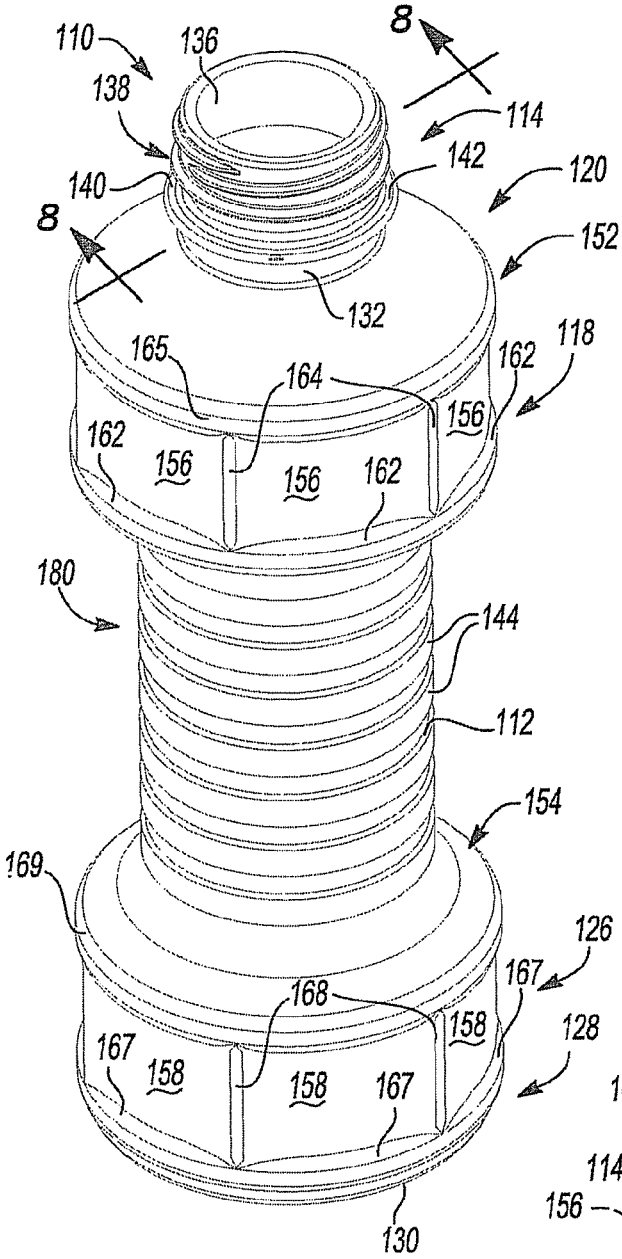
FIG. 5 is a perspective view of a plastic container constructed in accordance with additional teachings of the present disclosure.
Figure 7:
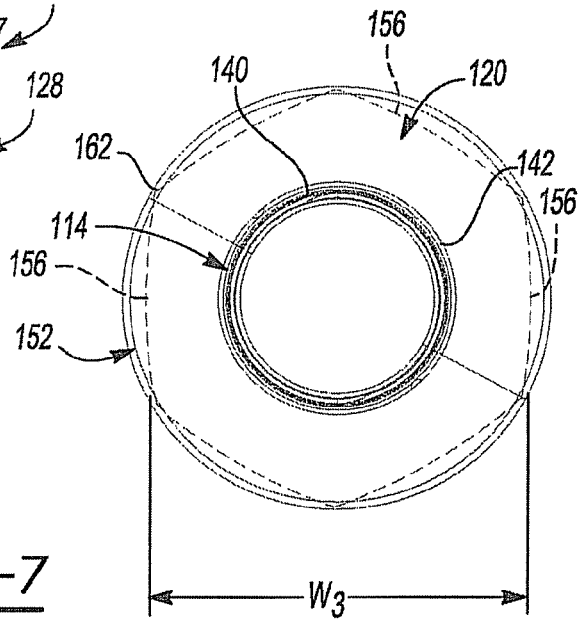
FIG. 7 is a top view of the plastic container of FIG. 5.

Upon filling, capping, sealing and cooling, as illustrated in FIG. 4 in phantom, the horizontal connecting walls 62 each act as a hinge that aids in the allowance of the underlying surface 66 of vacuum panels 56 to be pulled radially inward, toward the central longitudinal axis 60 of the plastic container 10, displacing volume, as a result of vacuum forces. In this position, the underlying surface 66 of vacuum panels 56, in cross section, illustrated in FIG. 4 in phantom, forms a generally concave surface 66'. The configuration of the sidewall portion 22 and the vacuum panel region 26, allow the vacuum reaction to be absorbed in a controlled manner by the vacuum panels 56 without substantial disruption to the label panel area 70 or a remainder of the plastic container 10.

As illustrated in FIG. 2, the vacuum panels 56 have a width $W_2$. In one example, for the plastic container 10 having a nominal capacity of approximately 16.9 fl. oz. (500 cc), the width $W_2$ may be about 43.81 mm (1.72 inches). A height $H_2$ defined at an outermost edge of the vacuum panels 56 may be about 27.16 mm (1.07 inches). The height $H_2$ may vary slightly across the width $W_2$ of the vacuum panels 56. A height $H_3$ defined from the shoulder region 20 to a transition between the sidewall portion 22 and the vacuum panel region 26 may be about 74.33 mm (2.93 inches). A height $H_4$ of the finish 16 may be about 19.71 mm (0.76 inch). A height $H_5$ of the base portion 28 may be about 48.08 mm (1.89 inches).

Figure 6:
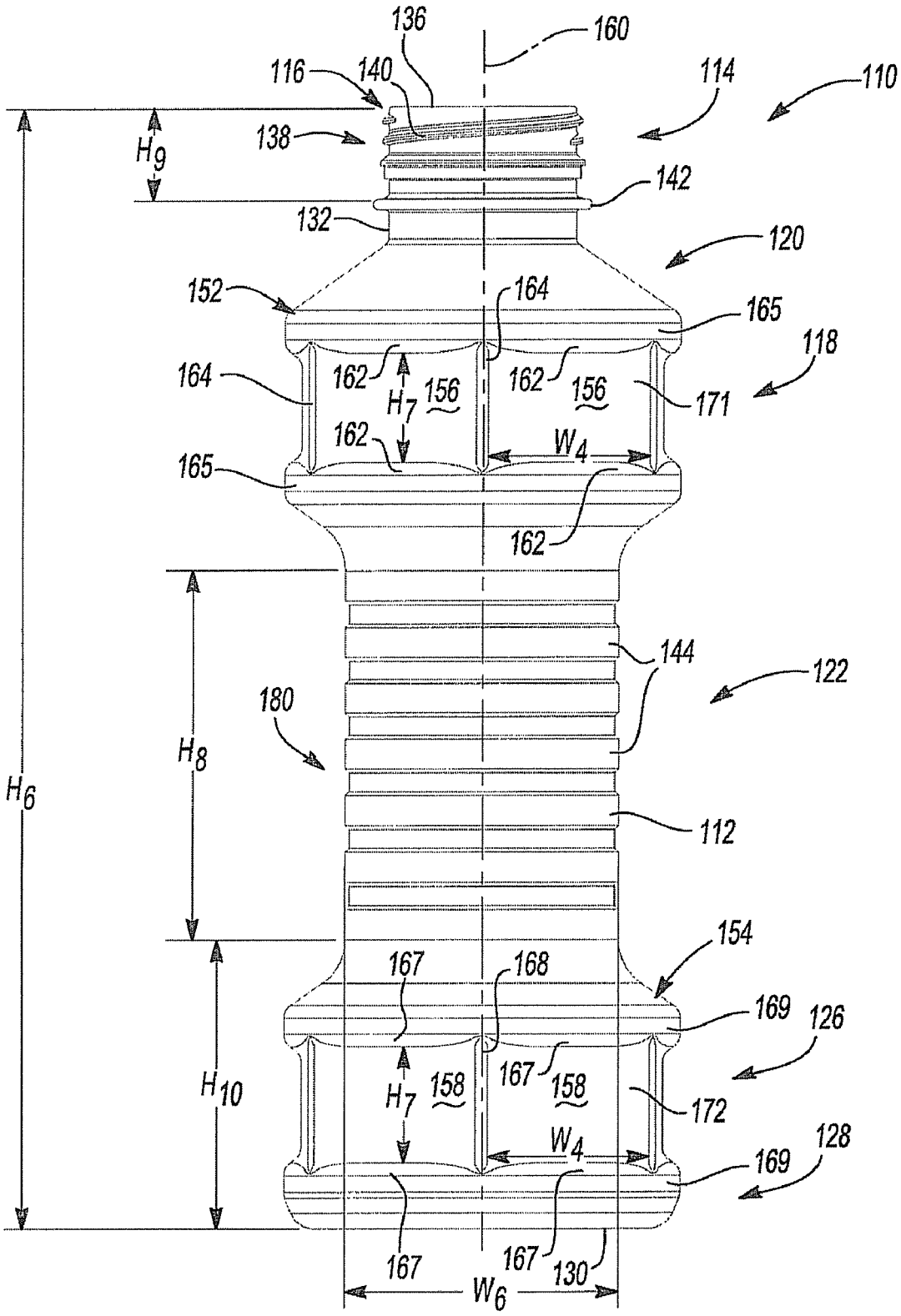
FIG. 6 is a side elevational view of the plastic container of FIG. 5.

With reference to FIGS. 5-8, a plastic, e.g. polyethylene terephthalate (PET), hot-fillable container according to the present teachings is shown and generally identified at reference number 110. As shown in FIG. 6, the plastic container 110 has an overall height $H_6$ of about 262.92 mm (10.35 inches). The height $H_6$ may be selected so that the plastic container 110 fits on the shelves of a supermarket or store. Again, it is contemplated that other modifications can be made depending on the specific application.

The plastic container 110 according to the present teachings defines a body 112 and includes an upper portion 114 having a finish 116. Integrally formed with the finish 116 and extending downward therefrom is a shoulder region 120. The shoulder region 120 merges into and provides a transition between the finish 116 and a first vacuum panel region 118. The first vacuum panel region 118 merges into a sidewall portion 122. The sidewall portion 122 extends downward from the first vacuum panel region 118 to a second vacuum panel region 126. The second vacuum panel region 126 can transition into a base portion 128 having a base 130. A neck 132 may also be included having an extremely short height, that is, becoming a short extension from the finish 116, or an elongated height, extending between the finish 116 and the shoulder region 120. The plastic container 110 has been designed to retain a commodity. The commodity may be in any form such as a solid or liquid product. In one example, a liquid commodity may be introduced into the plastic container 110 during a thermal process, typically a hot-fill process, such as described above. In another example, the commodity may be introduced into the plastic container 110 under ambient temperatures.

The finish 116 of the plastic container 110 includes a portion defining an aperture or mouth 136, and a threaded region 138 having threads 140. The finish 116 can also define a support ring 142. The support ring 142 may be used to carry or orient a preform (the precursor to the plastic container 110, not illustrated) through and at various stages of manufacture. For example, the preform may be carried by the support ring 142, the support ring 142 may be used to aid in positioning the preform in the mold, or an end consumer may use the support ring 142 to carry the plastic container 110 once manufactured.

The aperture 136 allows the plastic container 110 to receive a commodity while the threaded region 138 provides a means for attachment of a similarly threaded closure or cap (not illustrated). Accordingly, the closure or cap (not illustrated) engages the finish 116 to preferably provide a hermetical seal of the plastic container 110. The closure or cap (not illustrated) is preferably of a plastic or metal material conventional to the closure industry and suitable for subsequent thermal processing, including high temperature pasteurization and retort.

The sidewall portion 122 includes a series of horizontal ribs 144. The horizontal ribs 144 circumscribe the entire perimeter of the sidewall portion 122 of the plastic container 110. The horizontal ribs 144 extend continuously in a longitudinal direction from the first vacuum panel region 118 to the second vacuum panel region 126. According to one example, the sidewall portion 122 can define a width $W_6$. The width $W_6$ can be approximately 50.8 mm (2.0 inches). The base 130 functions to close off the base portion 128 of the plastic container 110 and, together with the finish 116, the shoulder region 120, the sidewall portion 122, and the first and second vacuum panel regions 118 and 126, respectively, to retain the commodity.

The first and second vacuum panel regions 118 and 126 are generally defined at first and second stepped-out portions 152 and 154, respectively, of the plastic container 110. The figures and the following description are directed toward first and second vacuum panel regions that are substantially equivalent in formation, however, they may be formed differently from each other. The first and second vacuum panel regions 118 and 126 each define a plurality of vacuum panels 156 and 158, respectively, generally extending on respective planes that are parallel to a central longitudinal axis 160 of the plastic container 110. According to one example, the stepped-out portions 152 and 154 can define a width $W_3$ between opposing vacuum panels 156 (and likewise, opposing vacuum panels 158). The width $W_3$ can be approximately 67.06 mm (2.64 inches). As in the previous example, preferably, the width $W_3$ may be at least 10% greater than the width $W_6$. More preferably, the width $W_3$ may be about 20%-40% greater than the width $W_6$.

As illustrated in FIGS. 5-8, the vacuum panels 156 and 158 may be generally rectangular in shape. It is appreciated that the vacuum panels 156 and 158 may define other geometrical configurations as well. Accordingly, the plastic container 110 illustrated in the FIGS. 5-8 has six (6) vacuum panels 156 defined on the first vacuum panel region 118, and six (6) vacuum panels 158 defined on the second vacuum panel region 126. The inventors however equally contemplate that more than or less than six (6) vacuum panels 156 and 158 can be provided. By way of example, one or both of the first and second vacuum panel regions 118 and 126 can also be formed on the plastic container 110 having two (2), three (3), four (4), five (5), seven (7) or eight (8) vacuum panels. As illustrated, the present teachings facilitate the orientation of vacuum panels 156 and 158 in a horizontal direction relative to the central longitudinal axis 160 of the plastic container 110.

Surrounding the vacuum panels 156 are horizontal and vertical connecting walls 162 and 164, respectively. Each horizontal connecting wall 162 is generally defined between the vacuum panel 156 and an adjacent radial surface 165. The horizontal connecting walls 162 define a generally arcuate profile in horizontal cross-section (see FIG. 8). Each vertical connecting wall 164 is defined between adjacent vacuum panels 156.

Surrounding the vacuum panels 158 are horizontal and vertical connecting walls 167 and 168, respectively. Each horizontal connecting wall 167 is generally defined between the vacuum panel 158 and an adjacent radial surface 169. The horizontal connecting walls 167 define a generally arcuate profile in horizontal cross-section (see FIG. 8). Each vertical connecting wall 168 is defined between adjacent vacuum panels 158.

Optionally, each horizontal connecting wall 162 and 167 may define a distinctly identifiable structure between the adjacent radial surfaces 165 and 169 and an underlying surface 171 and 172 of vacuum panels 156 and 158, respectively. The horizontal connecting walls 162 and 167 provide strength to the transition between the adjacent radial surfaces 165 and 169 and the underlying surfaces 171 and 172. The resulting localized strength increases the resistance to creasing and denting in the first and second vacuum panel regions 118 and 126, and the plastic container 110 as a whole.

A label panel area 180 is defined at the sidewall portion 122. The label panel area 180 therefore occupies a distinct portion of the plastic container 110 relative to the first and second vacuum panel regions 118 and 126. In this example, the label panel area 180 is defined between the first and second vacuum panel regions 118 and 126. As is commonly known and understood by container manufacturers skilled in the art, a label (not shown) may be applied to the sidewall portion 122 (label panel area 180) using methods that are well known to those skilled in the art, including shrink-wrap labeling and adhesive methods. As applied, the label may extend around the entire body 112 or be limited to a partial circumference of the sidewall portion 122.

Figure 8:
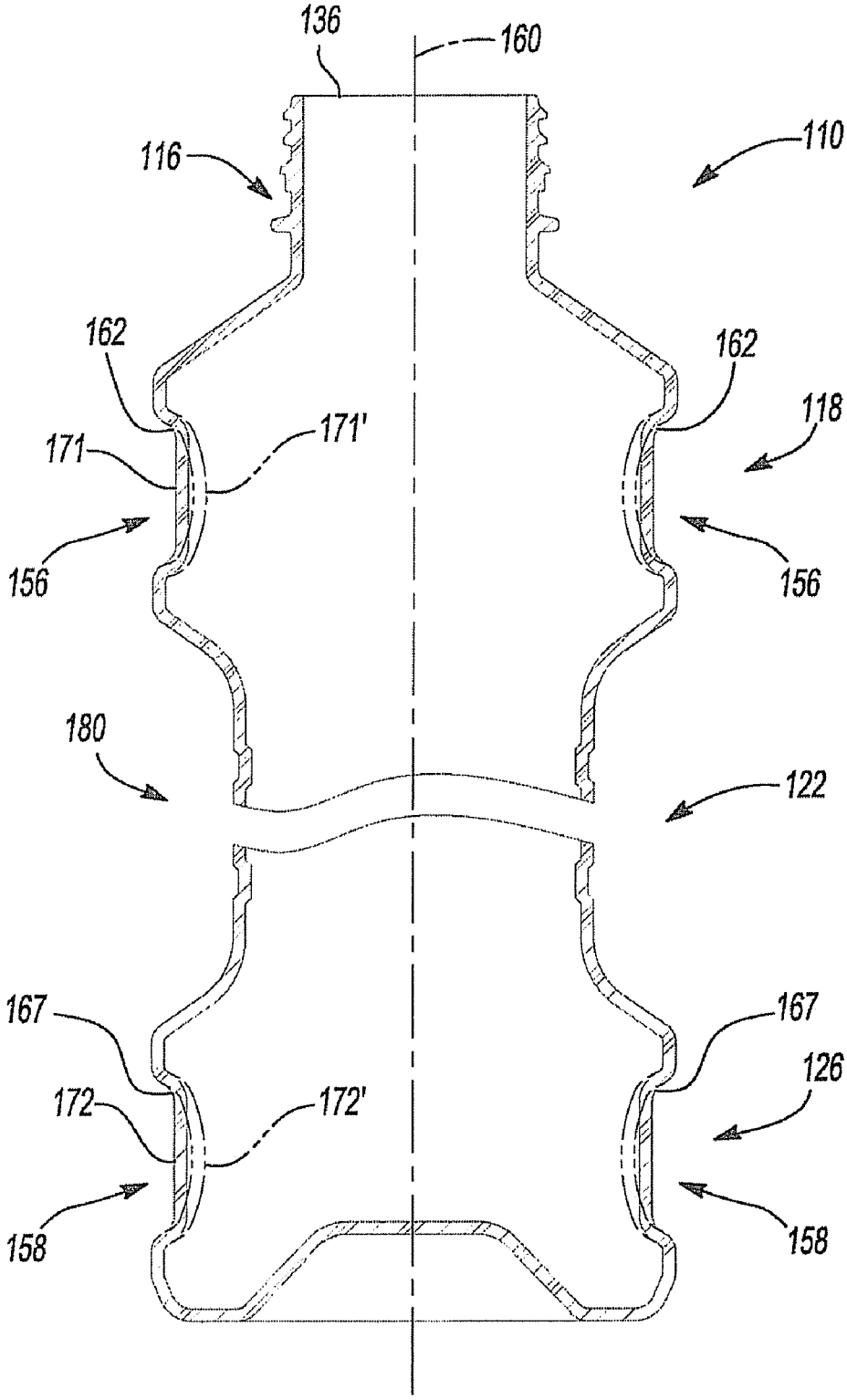
FIG. 8 is a cross-sectional view of the plastic container taken along line 8-8 of FIG. 5.

Upon filling, capping, sealing and cooling, as illustrated in FIG. 8 in phantom, the horizontal connecting walls 162 and 167 each act as a hinge that aids in the allowance of the underlying surface 171 and 172 of vacuum panels 156 and 158 to be pulled radially inward, toward the central longitudinal axis 160 of the plastic container 110, displacing volume, as a result of vacuum forces. In this position, the underlying surface 171 and 172 of vacuum panels 156 and 158, in cross section, illustrated in FIG. 8 in phantom, form a generally concave surface 171' and 172', respectively. The configuration of the sidewall portion 122 and the first and second vacuum panel regions 118 and 126, allow the vacuum reaction to be absorbed in a controlled manner by the vacuum panels 156 and 158 without substantial disruption to the label panel area 180 or a remainder of the plastic container 110.

As illustrated in FIG. 6, the vacuum panels 156 and 158 have a width $W_4$. In one example, for the plastic container 110 having a nominal capacity of approximately 16.9 fl. oz. (500 cc), the width $W_4$ may be about 34.63 mm (1.36 inches). A height $H_7$ defined at an outermost edge of vacuum panels 156 and 158 may be about 21.16 mm (0.83 inch). The height $H_7$ may vary slightly across the width $W_4$ of the vacuum panels 156 and 158. A height $H_8$ defined by the sidewall portion 122 (label panel area 180) may be about 76.29 mm (3.00 inches). A height $H_9$ of the finish 116 may be about 18.62 mm (0.73 inch). A height $H_{10}$ of the second vacuum panel region 126 and the base portion 128 may be about 74.81 mm (2.95 inches).

While the above description constitutes the present disclosure, it will be appreciated that the disclosure is susceptible to modification, variation and change without departing from the proper scope and fair meaning of the accompanying claims.

What is claimed is:

1. A plastic container that receives a label, the plastic container comprising:

an upper portion having a mouth defining an opening into said container;

a shoulder region extending from said upper portion; and a sidewall portion extending between said shoulder region and a base portion, said base portion closing off an end of said container, said sidewall portion including a first region and a vacuum panel region, said first region being elongated along a longitudinal axis of the container to receive the label;

said vacuum panel region formed on the plastic container and defined in part by at least two generally rectangular shaped vacuum panels formed therein, each of said at least two vacuum panels defining a plane that is substantially parallel to said longitudinal axis of the plastic container and being movable to accommodate vacuum forces generated within the container resulting from heating and cooling of its contents, said vacuum panel region having a first vacuum panel region, and a second vacuum panel region, wherein said first region of said sidewall portion is formed intermediate of said first and second vacuum panel regions, and occupying an area outboard of said first region of said sidewall portion to be distinct from said first region and the label, wherein a width of said vacuum panel region is at least 10% greater than a width of said first region of said sidewall portion.

2. The plastic container of claim 1 wherein a width of said vacuum panel region is approximately 20% to approximately 40% greater than a width of said first region of said sidewall portion.

3. The plastic container of claim 1 wherein each of said vacuum panels is oriented in a horizontal direction relative to said longitudinal axis of said container.

4. The plastic container of claim 3 wherein said at least two vacuum panels include three pair of vacuum panels.

5. The plastic container of claim 4 wherein each of said vacuum panels oppose a corresponding vacuum panel.

6. The plastic container of claim 1 wherein said first vacuum panel region defines an outer profile substantially equivalent to an outer profile defined by said second vacuum panel region.

7. The plastic container of claim 6 wherein said first vacuum panel region and said second vacuum panel region both define three pair of vacuum panels.

8. The plastic container of claim 7 wherein each of said vacuum panels is oriented in a horizontal direction relative to said longitudinal axis of said container.

9. The plastic container of claim 1 wherein said first region of said sidewall portion comprises a generally cylindrical body.

10. The plastic container of claim 9 wherein said first region of said sidewall portion further comprises a series of horizontal ribs, said horizontal ribs substantially circumscribing a perimeter of said first region of said sidewall portion.

11. The plastic container of claim 10 wherein said base portion defines a cylindrical outer surface defining an outer base width generally less than an outer vacuum panel region width defined by said vacuum panel region and greater than an outer sidewall width defined by said first region of said sidewall portion.

12. The plastic container of claim 1 wherein said vacuum panel region is defined by a plurality of planar vacuum panels having a common height measured parallel to said longitudinal axis of the container, said vacuum panel region having a polygonal cross section taken perpendicular to said longitudinal axis, said polygonal cross section chosen from a group consisting of a triangular, quadrilateral, pentagonal, hexagonal, heptagonal, and octagonal cross section, said polygonal cross section remaining substantially constant along the entirety of said height.

13. A plastic container that receives a label, the plastic container comprising:

an upper portion having a mouth defining an opening into said container;

a shoulder region extending from said upper portion;

a sidewall portion extending between said shoulder region and a base portion, said sidewall portion being elongated along a longitudinal axis of the container to receive the label, said base portion closing off an end of said container; and a vacuum panel region formed on the plastic container and defined in part by at least two vacuum panels formed therein, each of said at least two vacuum panels being movable to accommodate vacuum forces generated within the container resulting from heating and cooling of its contents, said vacuum panel region occupying an area outboard of said sidewall portion to be distinct from said sidewall portion and the label, wherein said at least two vacuum panels each define a plane that is substantially parallel to said longitudinal axis of the plastic container, wherein said at least two vacuum panels include at least two generally rectangular shaped vacuum panels, wherein said vacuum panel region comprises:

a first vacuum panel region; and a second vacuum panel region, wherein said sidewall portion is formed intermediate of said first and second vacuum panel regions, wherein said first vacuum panel region defines an outer profile substantially equivalent to an outer profile defined by said second vacuum panel region, and wherein a width of at least one of said first vacuum panel region and said second vacuum panel region is approximately 20% to approximately 40% greater than a width of said sidewall portion.

14. A plastic container filled with a liquid at an elevated temperature, sealed with a closure, labeled with a label, and cooled thereby establishing a vacuum within said container, said container comprising:

an upper portion having a mouth defining an opening into said container;

a shoulder region extending from said upper portion; and a sidewall portion extending between said shoulder region and a base portion, said base portion closing off an end of said container, said sidewall portion including a first vacuum panel region, a second vacuum panel region, and a first region formed intermediate of said first and second vacuum panel regions, said first region being elongated along a longitudinal axis of the container to receive the label, said first vacuum panel region and said second vacuum panel region each defining a substantially hexagonal shape in horizontal cross-section, a first vacuum panel being defined on each of six sides defined by said first vacuum panel region, a second vacuum panel being defined on each of six sides defined by said second vacuum panel region, each of said first and second vacuum panels being movable to accommodate vacuum forces generated within the container resulting from heating and cooling of its contents, wherein a width of at least one of said first and second vacuum panel regions is approximately 20% to approximately 40% greater than a width of said first region of said sidewall portion to be distinct from said first region and the label.

15. The plastic container of claim 14 wherein said first vacuum panel region defines an outer profile substantially equivalent to an outer profile defined by said second vacuum panel region.

16. The plastic container of claim 14 wherein each vacuum panel of at least one of said first and second vacuum panel regions defines a planar surface that is substantially parallel to said longitudinal axis of the plastic container.

17. The plastic container of claim 14 wherein said first region of said sidewall portion further comprises a series of horizontal ribs, said horizontal ribs substantially circumscribing a perimeter of said sidewall portion.

18. A plastic container filled with a liquid at an elevated temperature, sealed with a closure, labeled with a label, and cooled thereby establishing a vacuum within said container, said container comprising:

an upper portion having a mouth defining an opening into said container;

a shoulder region extending from said upper portion;

a sidewall portion extending between said shoulder region and a base portion, said sidewall portion including a label panel area defining a substantially circular shape in horizontal cross-section, said label panel area being elongated along a longitudinal axis of the container to receive the label, said sidewall portion also including a vacuum panel region, said base portion closing off an end of said container, said vacuum panel region formed on the plastic container defining a plurality of planar vacuum panels each extending substantially parallel to said longitudinal axis of the container, each of said planar vacuum panels having a common height measured parallel to said longitudinal axis of the container, said vacuum panel region having a first vacuum panel region, and a second vacuum panel region, wherein said label panel area is formed intermediate of said first and second vacuum panel regions, and a polygonal cross section taken perpendicular to said longitudinal axis, said polygonal cross section chosen from a group consisting of a hexagonal and octagonal cross section, said polygonal cross section remaining substantially constant along the entirety of said height, wherein said plurality of vacuum panels comprises three pair of vacuum panels, wherein said vacuum panel of said plurality of vacuum panels opposes another vacuum panel of said plurality of vacuum panels, and each of said vacuum panels is movable to accommodate vacuum forces generated within the container resulting from heating and cooling of its contents, and is offset outboard of said label panel area to be distinct from the label panel area and the label.

* * * * *